US006981745B2

(12) United States Patent
Rees

(10) Patent No.: US 6,981,745 B2
(45) Date of Patent: Jan. 3, 2006

(54) RECONFIGURABLE CHAIR

(76) Inventor: John Christopher Rees, 2 Thistleboon Drive, Mumbeles,Swansea, SA3 4HZ (GB)

( * ) Notice: Subject to any disclaimer, the term of this patent is extended or adjusted under 35 U.S.C. 154(b) by 0 days.

(21) Appl. No.: 10/852,385

(22) Filed: May 24, 2004

(65) Prior Publication Data

US 2004/0212181 A1 Oct. 28, 2004

Related U.S. Application Data

(63) Continuation of application No. PCT/GB02/05256, filed on Nov. 22, 2002.

(30) Foreign Application Priority Data

Nov. 22, 2001 (GB) ..... 0128058
Nov. 22, 2001 (GB) ..... 0128059
Nov. 22, 2001 (GB) ..... 0128061
Nov. 22, 2001 (GB) ..... 0128063
Nov. 22, 2001 (GB) ..... 0128064

(51) Int. Cl.
*A47C 1/02* (2006.01)

(52) U.S. Cl. ..... 297/344.14; 297/330; 297/85; 297/217.3; 280/735; 180/273

(58) Field of Classification Search ..... 297/330, 297/85, 217.3, DIG. 10; 280/735; 180/273; 73/795; 324/687
See application file for complete search history.

(56) References Cited

U.S. PATENT DOCUMENTS 4,404,632 A 9/1983 Harada et al. ..... 364/425
4,786,107 A 11/1988 Crockett ..... 297/330
4,956,592 A 9/1990 Schulte et al. ..... 318/560
5,467,002 A 11/1995 Brooks ..... 318/553
5,585,779 A 12/1996 Halikias ..... 340/426
5,730,494 A 3/1998 LaPointe et al. ..... 297/330
5,822,707 A * 10/1998 Breed et al. ..... 701/49
5,931,532 A 8/1999 Kemmerer et al. ..... 297/330
6,154,690 A 11/2000 Coleman ..... 701/1
6,213,554 B1 4/2001 Marcoux et al. ..... 297/330
6,492,786 B1 * 12/2002 Vang et al. ..... 318/553

FOREIGN PATENT DOCUMENTS

| | | |
|---|---|---|
| DE | 7122985 | 11/1972 |
| EP | 1251027 | 7/1998 |
| GB | 2098859 | 5/1981 |
| GB | 2213660 | 8/1989 |
| GB | 2250187 | 3/1992 |
| JP | 3244411 | 10/1991 |
| JP | 9206153 | 8/1997 |
| JP | 10066779 | 3/1998 |
| JP | 10127397 | 5/1998 |
| WO | WO 00/44018 | 7/2000 |
| WO | WO 0044018 | 7/2000 |
| WO | WO 0211585 | 2/2002 |
| WO | WO 03045191 | 6/2003 |

* cited by examiner

*Primary Examiner*—Laurie K. Cranmer
(74) *Attorney, Agent, or Firm*—Gordon & Jacobson, P.C.

(57) ABSTRACT

A reconfigurable chair arranged for ease of operation by an elderly or disabled person, to change configuration to assist a person in sitting and standing, to limit the risk of a person becoming trapped in the operating mechanisms thereof and/or comprising means for sensing an abnormal load condition.

46 Claims, 5 Drawing Sheets

RECONFIGURABLE CHAIR

This application is a continuation of PCT/GB02/05256 filed on Nov. 22, 2002.

BACKGROUND OF THE INVENTION

1. Field of the Invention

The present invention relates to a reconfigurable chair and, more particularly to a reconfigurable chair arranged for ease of operation by an elderly or disabled person, to change configuration to assist a person in sitting and standing, to limit the risk of a person becoming trapped in the operating mechanisms thereof and/or comprising means for sensing an abnormal load condition.

2. Related Background Art

It is known to provide a chair whose configuration may be varied by the operation of one or more actuators, for example to vary the configuration of the chair between an upright position and a reclined position or to tilt the chair forwards to assist a person in standing.

The configuration of this prior art chair is typically adjusted by a user, who controls the operation of the or each actuator via a handset.

However, for the elderly or disabled, being those most likely to employ such a seating arrangement, a handset can prove difficult to manipulate.

It is therefore a first object of the present invention to provide an arrangement which obviates the requirement for a handset to adjust the configuration of a reconfigurable chair.

A further drawback of the prior art chair is that it is often difficult for a person to reseat himself or herself when the chair is in a forwards tilted position and so he or she will be required to operate the handset to return the chair to an upright position before sitting, thereby lengthening the amount of time that the person must remain unseated. As such seats are typically used by elderly or disabled persons, such a delay may easily result in a fall or, collapse and is therefore unsatisfactory.

Furthermore, we have found that it is uncommon for a person to return a forwards tilted seat to an upright position immediately upon standing and thus the seat may remain in a forwards tilted position for some period of time, during which the chair might inadvertently be returned to an upright position by a child, thereby giving rise to the risk of entrapment.

It is therefore a second object of the present invention to provide an arrangement which obviates the requirement for an unseated person to return a reconfigurable chair from tilted position to an upright position.

Sadly, cases have recently been reported of persons being injured through a part of their body becoming trapped in the operating mechanisms of the prior art chair, when the actuators thereof are accidentally operated.

It is therefore a third object of the present invention to provide an arrangement wherein the risk of such entrapment is reduced.

It is also known to provide the prior art chair with means for sensing an abnormal increase in current drawn by the actuator(s) thereof, indicative of an abnormal load condition.

However, where a single actuator is used to adjust, in sequence, the positions of two or more different parts of a chair, the amount of current drawn by the actuator in each stage of adjustment may differ substantially. For example, a single actuator may be arranged adjust the position of the squab and/or back of the chair, therein drawing a current of approximately 5 amps, and, as a separate operation, the position of a footrest, therein drawing a lesser current of approximately 1 amp.

Hitherto, the current sensing means associated with such an actuator arrangement have been arranged to sense when the current drawn by the actuator exceeds a particular value, greater than that which is normally drawn during the adjustment of the squab and/or back of the chair, and thus an abnormal load condition, when adjusting the position of the footrest, will not be detected until the increase in current drawn by the actuator far exceeds a level at which serious damage to the operating mechanism of the footrest may result.

It is therefore a fourth object of the present invention to provide an arrangement wherein an abnormal load maybe sensed in different configurations of a reconfigurable chair.

SUMMARY OF THE INVENTION

According to a first aspect of the present invention, there is provided a chair comprising at least one actuator for adjusting the configuration of the chair and means by which a user can control the operation of the or each actuator to vary the configuration of the chair, in opposite directions, via respective switches or sensors on either side of the chair.

Preferably the operation of the or each actuator is controlled via respective proximity sensors on either side of the chair, each proximity sensor preferably comprising a charge-transfer capacitance sensor, such as the QT 110 sensor produced by Quantum Research Group Limited, wherein a fixed charge is transferred from a sensing element (whose capacitance is affected by the proximity of a seated person) to a sampling capacitor of known capacitance, the resulting voltage across the sampling capacitor providing a measure of the extent to which the capacitance of the sensing element is affected.

The sensing element may comprise one or more wires incorporated into piping which extends across or around an edge of the side of the chair.

According to a second aspect of the present invention, there is provided an electronic control arrangement for controlling the operation of at least one actuator for adjusting the configuration of the chair, the arrangement comprising means by which a user can control the operation of the or each actuator to vary the configuration of the chair, in opposite directions, via respective switches or sensors on either side of the chair.

According to a third aspect of the present invention, there is provided a chair comprising at least one actuator for adjusting the configuration of the chair to tilt the chair forwards, means for sensing whether a person is seated in the chair for operating the or each actuator to return the chair from a tilted position to an upright position, when a person is no longer seated in the chair.

It will be appreciated that such an arrangement minimizes the length of time during which a person must remain unseated as well as limiting the risk of entrapment.

The sensing means may, for example, comprise a pressure transducer or proximity sensor, the latter preferably being in the form of charge-transfer capacitance sensor, such as the QT 110 sensor produced by Quantum Research Group Limited, wherein a fixed charge is transferred from a sensing element (whose capacitance is affected by the proximity of a seated person) to a sampling capacitor of known capacitance, the resulting voltage across the sampling capacitor providing a measure of the extent to which the capacitance of the sensing element is affected.

The sensing element may comprise one or more wires incorporated into piping formed around a cushion on the squab of the chair.

According to a fourth aspect of the present invention, there is provided an electronic control arrangement for controlling the operation of at least one actuator for adjusting the configuration of the chair to tilt the chair forwards, the arrangement comprising means for sensing whether a person is seated in the chair and for operating the or each actuator to return the chair from a tilted position to an upright position, when a person is no longer seated in the chair.

According to a fifth aspect of the present invention, there is provided a chair comprising at least one actuator for adjusting the configuration of the chair and a handset comprising a plurality of buttons for controlling the operation of the or each actuator, wherein the handset must be enabled prior to use, by pressing a plurality of buttons thereof in a predetermined sequence or combination.

Preferably the handset is automatically disabled when it has not been used for a pre-determined period time. Alternatively, the handset may be disabled by a user by operating a single button thereof or a plurality of buttons in a predetermined sequence or combination.

Preferably the sequence or combination of buttons which must be pressed to enable and/or disable the device can be set by the user.

According to a sixth aspect of the present invention, there is provided a chair comprising at least one actuator for adjusting the configuration of the chair and means for sensing whether a person is seated in the chair and for preventing the or each actuator from being operated via a handset or other operating device of the chair unless a person is seated in the chair.

It is therefore impossible for a person to adjust the configuration of the chair unless either himself or another person is seated in the chair, thereby ensuring that the seated person is well clear of the operating mechanisms of the chair and can assess whether any other person might be at risk before the chair is operated.

The sensing means may, for example, comprise a pressure transducer or proximity sensor, the latter preferably being in the form of charge-transfer capacitance sensor, such as the QT 110 sensor produced by Quantum Research Group Limited, wherein a fixed charge is transferred from a sensing element (whose capacitance is affected by the proximity of a seated person) to a sampling capacitor of known capacitance, the resulting voltage across the sampling capacitor providing a measure of the extent to which the capacitance of the sensing element is affected.

The sensing element may comprise one or more wires incorporated into piping formed around a cushion on the squab of the chair.

According to a seventh aspect of the present invention, there is provided an electronic control arrangement for controlling the operation of at least one actuator to adjust the configuration of a chair, the control arrangement comprising means for sensing whether a person is seated in the chair and for preventing the or each actuator from being operated via a handset or other operating device unless a person is seated in the chair.

According to a eighth aspect of the present invention, there is provided a chair comprising an actuator for adjusting the configuration of the chair in at least two stages and means arranged to detect an increase in current drawn by the actuator above a different respective threshold value in each of said stages.

Thus, an abnormal load condition may be detected in each of said stages.

Preferably the chair comprises means arranged to sense the prevailing configuration of the chair, for setting the appropriate threshold value.

The sensing means may, for example, comprise one or more switches or more elaborate position measuring means, such as one or more Hall Effect sensors or optical encoder devices for sensing the position of the actuator or a displaceable part of the chair.

Preferably said at least two stages comprise a first stage, wherein position of the squab and/or back of the chair is adjusted, and a second stage, wherein the position of a footrest of the chair is adjusted.

Preferably the detecting means are arranged to respond, when the current drawn by the actuator exceeds the prevailing threshold, by arresting or reversing the direction of adjustment of the chair and/or by generating an audible or visual alarm signal.

According to a ninth aspect of the present invention, there is provided an electronic control arrangement for controlling the operation of an actuator to adjust the configuration of a chair in at least two stages, the control arrangement comprising means for detecting an increase in current drawn by the actuator above a different respective threshold value in each of said stages.

Preferably the electronic control arrangement comprises means arranged to sense the prevailing configuration of the chair, for setting the appropriate threshold value.

BRIEF DESCRIPTION OF THE DRAWINGS

Embodiments of the present invention will now be described by way of examples only and with reference to the accompanying drawings, in which.

DETAILED DESCRIPTION OF THE PREFERRED EMBODIMENTS

Figure 1:
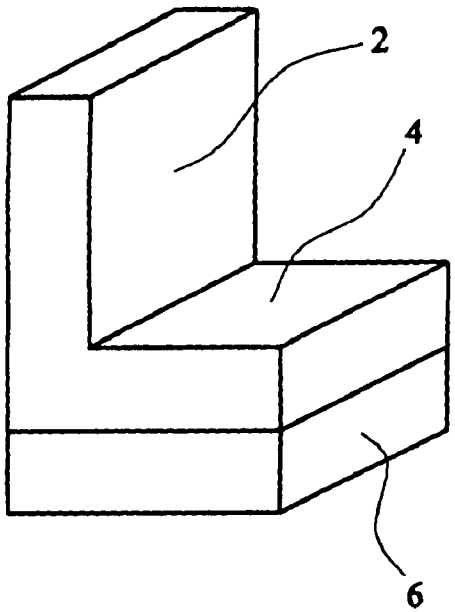
FIG. 1 is an isometric view of a first embodiment of chair in accordance with the present invention, showing the chair in a first, upright configuration.

Referring to FIG. 1 a chair is shown comprising a back 2 and a squab 4, pivotally mounted on a base 6.

Figure 2:
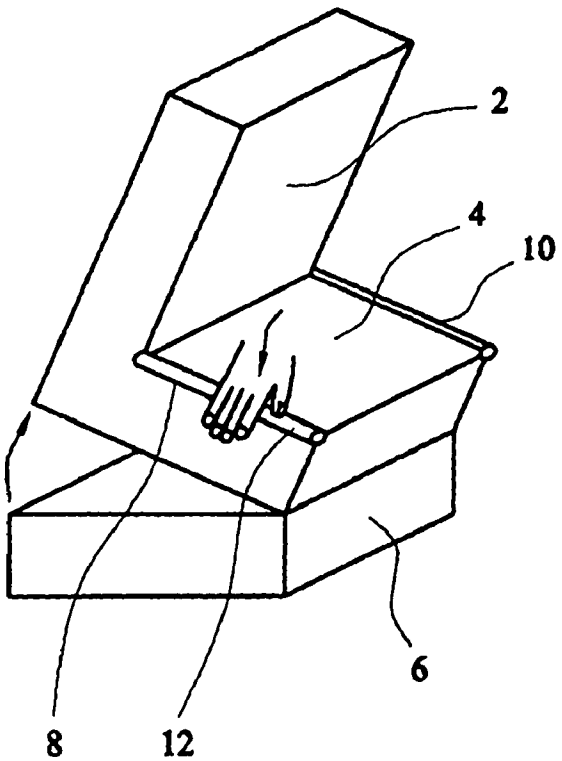
FIG. 2 is an isometric view showing the chair of FIG. 1 in a second, forwards-tilted configuration.

From the upright configuration shown in FIG. 1, an actuator (not shown) of the chair may be operated to reconfigure the chair, by tilting the back 2 and squab 4 in a forwards direction, as shown in FIG. 2, to assist a person in standing from the chair.

Figure 3:
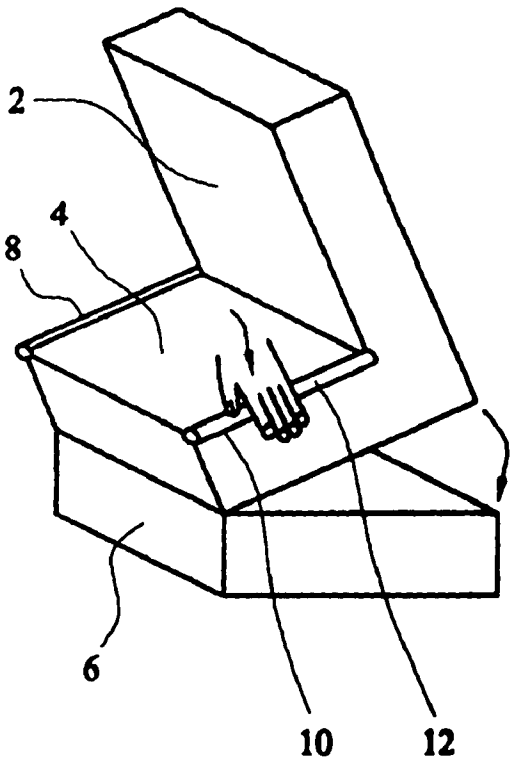
FIG. 3 is an isometric view showing the chair of FIG. 1 in a second, forwards-tilted configuration, from the opposite side of the chair to that shown in FIG. 2.

In order to obviate the requirement for a handset for controlling the operation of the actuator (such devices often being difficult to manipulate, especially by elderly or disabled persons), the chair of FIGS. 1 to 3 is instead provided with means by which a user can control the operation of the or each actuator to tilt the back 2 and squab 4 of the chair forwards and backwards, via respective sensors 8,10 on either side of the chair.

Each sensor 8,10 comprises a proximity sensor in the form of charge-transfer capacitance sensor, preferably based on the QT 110 sensor produced by Quantum Research Group Limited, wherein a fixed charge is transferred from one or more sensing wires 12 incorporated into piping along the side edge of the squab 4 and whose capacitance will therefore be affected by the proximity of the lowered hand of a seated person, to a sampling capacitor of known capacitance, the resulting voltage across the sampling capacitor providing a measure of the extent to which the capacitance of the sensing element is affected and thus an effective means for detecting whether a seated person has lowered his or her hand to operate the actuator.

The chair of FIGS. 1 to 3 is thus readily operated by persons lacking the manual dexterity required to manipulate a handset.

Figure 4:
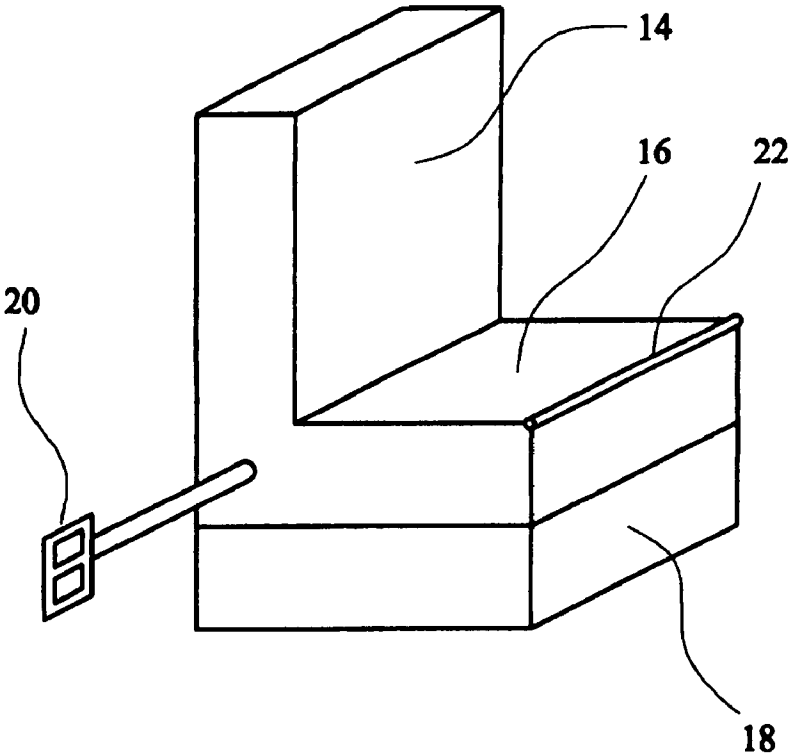
FIG. 4 is an isometric view of a second embodiment of chair in accordance with the present invention, showing the chair in a first, upright configuration.

Referring to FIG. 4 a chair is shown comprising a back 14 and a squab 16, pivotally mounted on a base 18.

Figure 5:
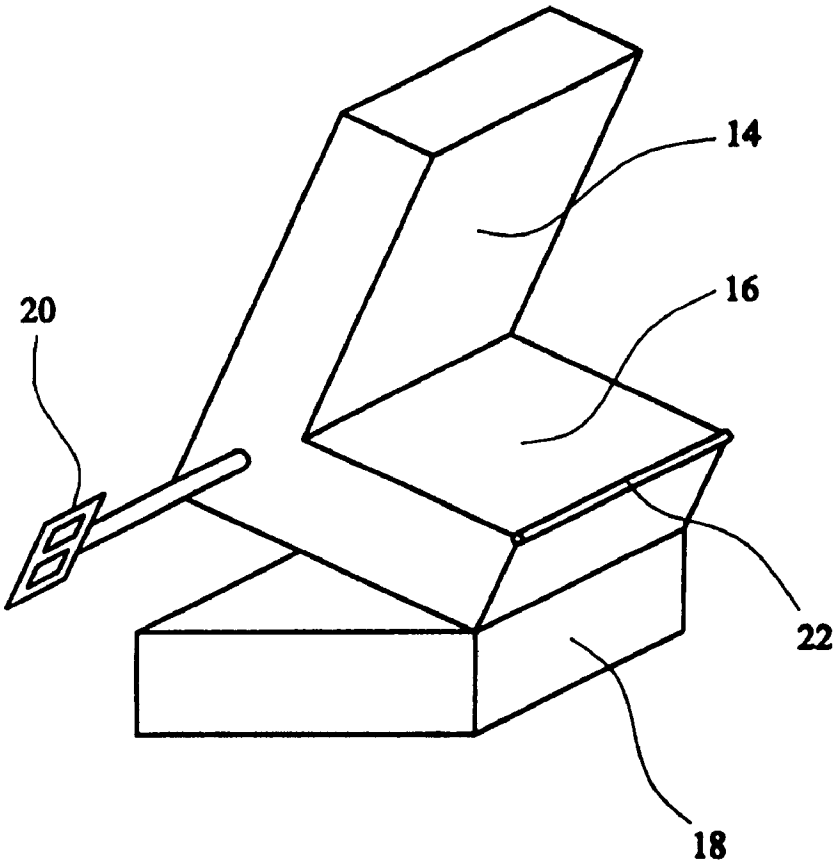
FIG. 5 is an isometric view showing the chair of FIG. 4 in a second, forwards-tilted configuration.

From the upright configuration shown in FIG. 4, an actuator (not shown) of the chair may be operated, via a handset 20, to reconfigure the chair, by tilting the back 14 and squab 16 in a forwards direction, as shown in FIG. 5, to assist a person in standing from the chair.

In order to reduce the delay in a person subsequently re-seating himself or herself and also the period of time during which entrapment might occur, the chair is provided with means for sensing whether a person is seated in the chair and for operating the or each actuator to return the chair from a tilted position to an upright position, when a person is no longer seated in the chair.

The sensing means comprise a proximity sensor in the form of charge-transfer capacitance sensor, preferably based on the QT 110 sensor produced by Quantum Research Group Limited, wherein a fixed charge is transferred from a one or more sensing wires 22, incorporated into piping along the forwards edge of the squab 16 and whose capacitance will therefore be affected by the proximity of a seated person, to a sampling capacitor of known capacitance, the resulting voltage across the sampling capacitor providing a measure of the extent to which the capacitance of the sensing element is affected and thus an effective means for detecting whether a person is seated on the chair.

The chair of FIGS. 4 and 5 thus provides an effective means for reducing the amount of time that a person must remain unseated therefrom and for limiting the risk of entrapment in the operating mechanisms of thereof.

Figure 6:
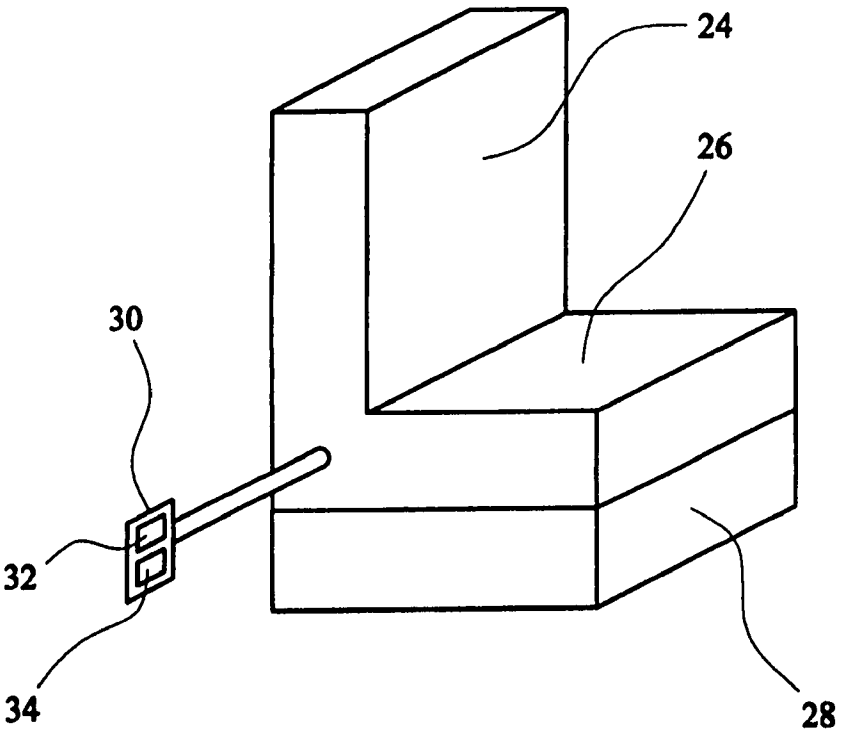
FIG. 6 is an isometric view of a third embodiment of chair in accordance with the present invention, showing the chair in a first, upright configuration.

Referring to FIG. 6 a chair is shown comprising a back 24 and a squab 26, pivotally mounted on a base 28.

Figure 7:
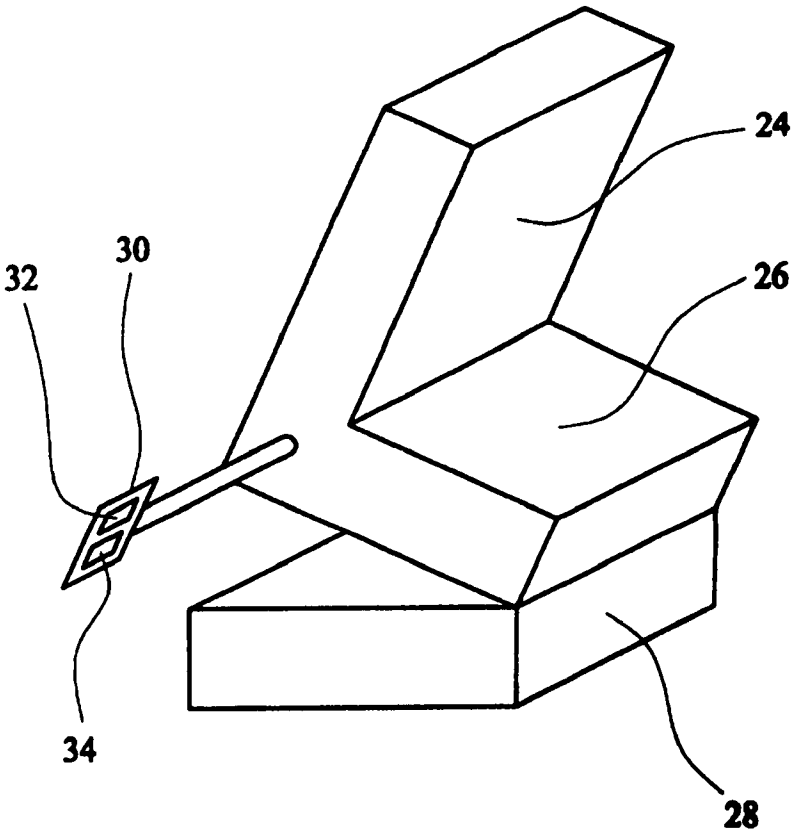
FIG. 7 is an isometric view showing the chair of FIG. 6 in a second, forwards-tilted configuration.

From the upright configuration shown in FIG. 6, an actuator (not shown) of the chair may be operated, via a handset 30, to reconfigure the chair, by tilting the back 24 and squab 26 in a forwards direction, as shown in FIG. 7.

In order to limit the risk of entrapment when the back 24 and squab 26 are subsequently tilted backwards to return the chair to an upright configuration, the handset 30 must be enabled prior to use, by pressing a plurality of buttons thereof 32,34 in a predetermined sequence or combination (chosen in advance by the user), and is automatically disabled when one or other of the buttons 32,34 thereof has not been pressed for a pre-determined period time.

The chair of FIGS. 6 and 7 thus provides an effective means for limiting the risk of entrapment in the operating mechanisms of thereof.

Figure 8:
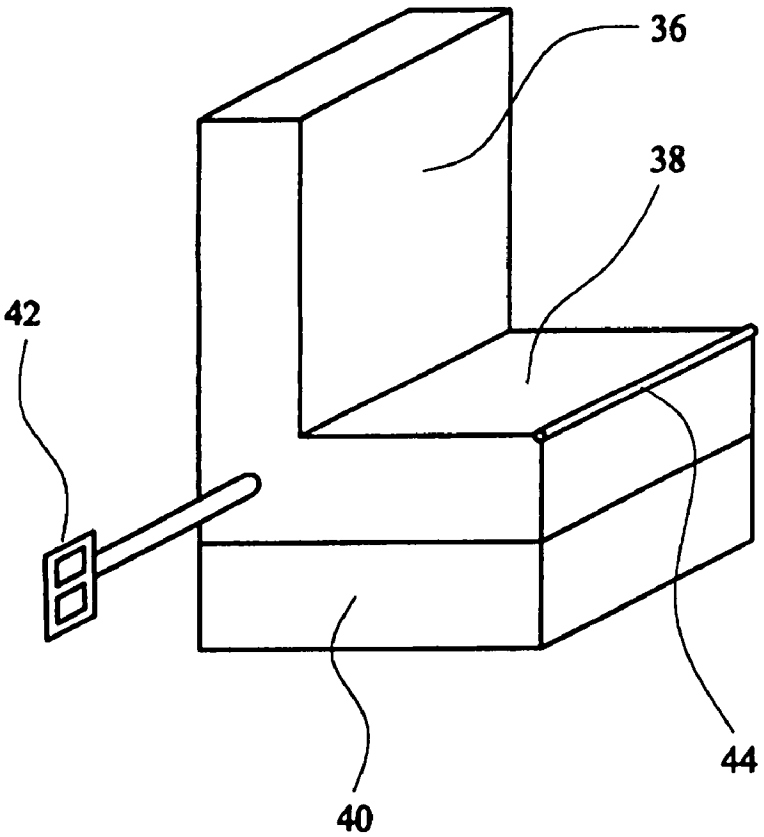
FIG. 8 is an isometric view of a fourth embodiment of chair in accordance with the present invention, showing the chair in a first, upright configuration.

Referring to FIG. 8, a chair is shown comprising a back 36 and a squab 38, pivotally mounted on a base 40.

Figure 9:
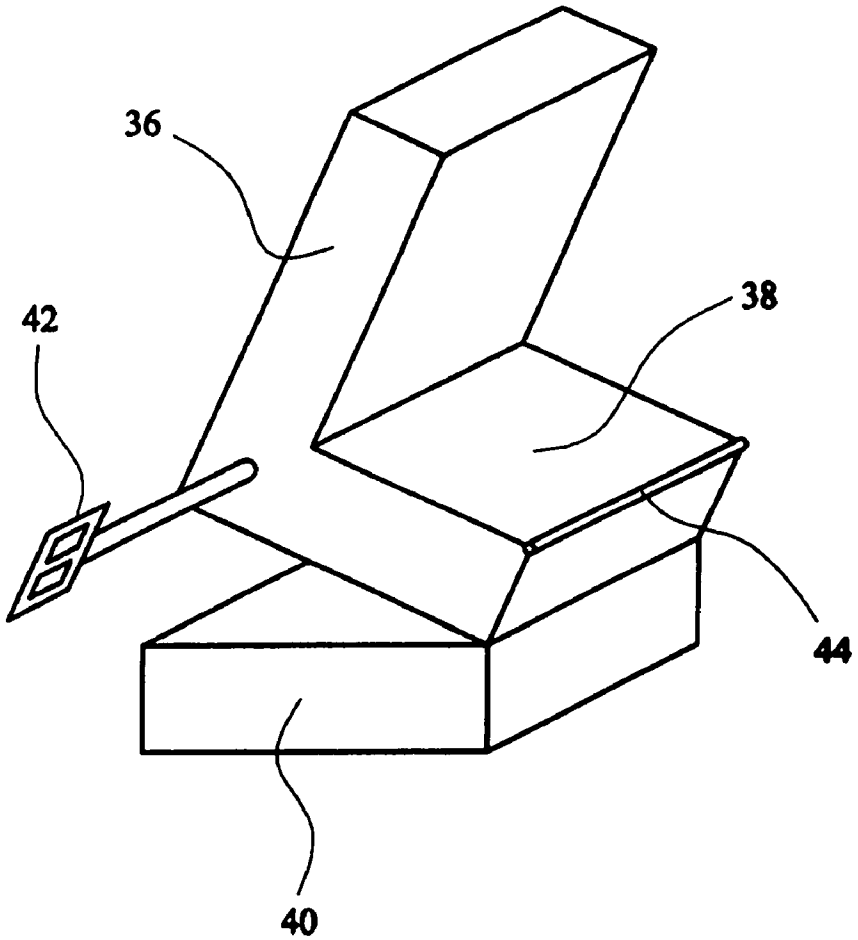
FIG. 9 is an isometric view showing the chair of FIG. 8 in a second, forwards-tilted configuration.

From the upright configuration shown in FIG. 8, an actuator (not shown) of the chair may be operated, via a handset 42, to reconfigure the chair, by tilting the back 36 and squab 38 in a forwards direction, as shown in FIG. 9.

In order to limit the risk of entrapment when the back 36 and squab 38 are subsequently tilted backwards to return the chair to an upright configuration, the chair is provided with means for sensing whether a person is seated in the chair and for preventing the actuator from being operated via the handset 42 unless a person is seated in the chair.

The sensing means comprise a proximity sensor in the form of charge-transfer capacitance sensor, preferably based on the QT 110 sensor produced by Quantum Research Group Limited, wherein a fixed charge is transferred from a one or more sensing wires 44, incorporated into piping along the forwards edge of the squab 38 and whose capacitance will therefore be affected by the proximity of a seated person, to a sampling capacitor of known capacitance, the resulting voltage across the sampling capacitor providing a measure of the extent to which the capacitance of the sensing element is affected and thus an effective means for detecting whether a person is seated on the chair.

The chair of FIGS. 8 and 9 thus provides an effective means for limiting the risk of entrapment in the operating mechanisms of thereof.

Figure 10:
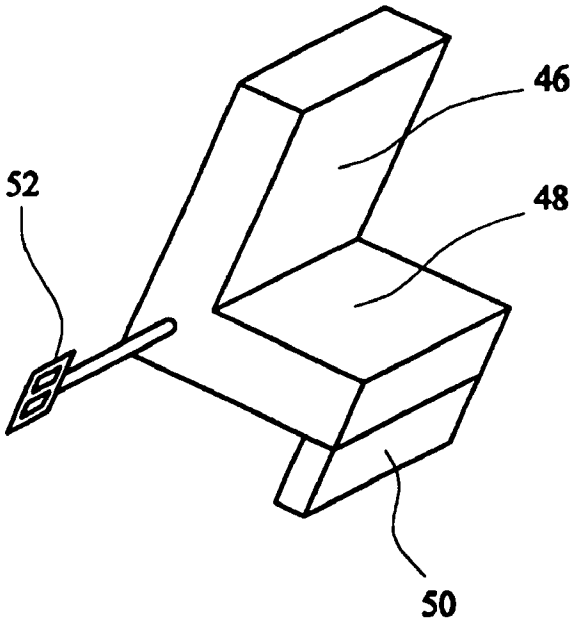
FIG. 10 is an isometric view of a fifth embodiment of chair in accordance with the present invention, showing the chair in a first, forwards-tilted configuration.

Referring to FIG. 10 a chair is shown comprising a back 46, a squab 48 and a retracted footrest 50.

From the forwards-tilted configuration shown in FIG. 10, an actuator (not shown) of the chair may be operated, via a handset 52, to re-configure the chair in a series of stages.

Figure 12:
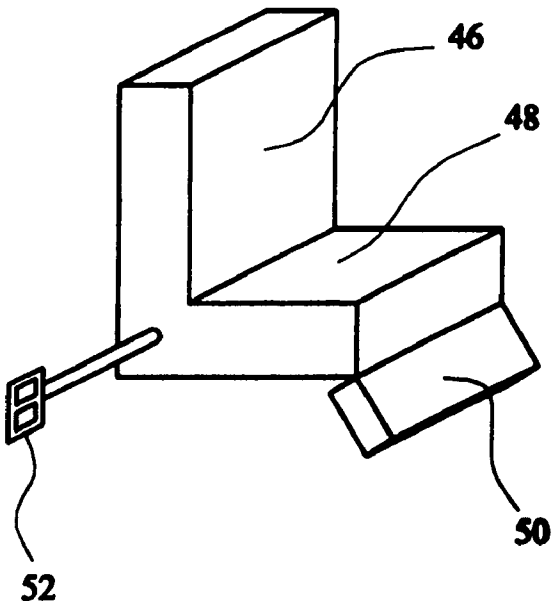
FIG. 12 is an isometric view showing the chair of FIG. 10 in a third, upright configuration, with the footrest of the chair extended.

Firstly, the actuator may be operated to tilt the chair backwards into an upright configuration. From this upright configuration, shown in FIG. 11, the actuator may then be operated either to tilt the chair forwards once again, or to extend the footrest 50, as shown in FIG. 12, the chair being arranged such that the footrest 50 is forced to retract before the chair can be tilted forwards.

Due to changes in the residual loading between stages of adjustment, the amount of current drawn by the actuator in each stage will be different, and consequently, so will the amount of current drawn by the actuator: when operating to tilt the chair forwards or backwards, the actuator might draw a current of say 5 amps, whereas when operating to extend or retract the footrest, the same actuator might draw a current of only 1 amp.

It is known to provide such a chair with current sensing means, for sensing when the current drawn by the actuator exceeds a particular value, greater than that which is normally drawn during tilting of the squab 48 and back 46 of the chair, to detect an abnormal load condition.

However, in such known arrangements, any abnormal increase in the current drawn by the actuator when adjusting the position of the footrest 50, will not be detected until that increase far exceeds a level at which serious damage to the operating mechanism of the footrest may result.

Figure 11:
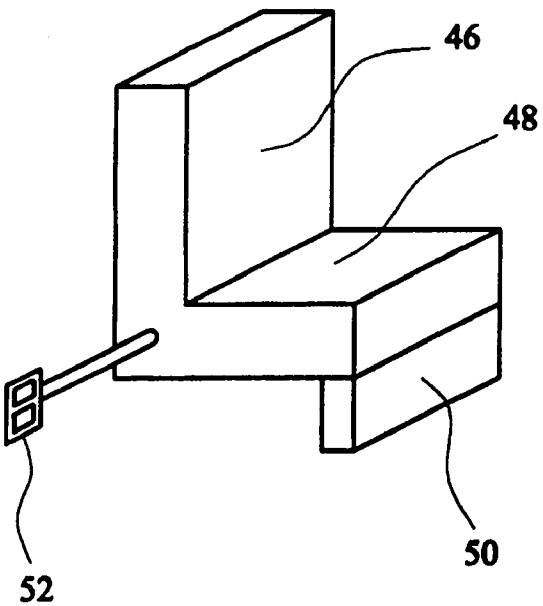
FIG. 11 is an isometric view showing the chair of FIG. 10 in a second, upright configuration, with a footrest of the chair retracted.

In the chair of FIGS. 10 to 12, this limitation is overcome by providing the chair with means (not shown) for sensing the prevailing configuration of the chair and for correspondingly adjusting the current threshold above which an abnormal load condition is deemed to have occurred, so that movement of the actuator can be reversed and an audible alarm sounded.

The sensing means may, for example, comprise one or more switches or more elaborate position measuring means, such as one or more Hall Effect sensors or optical encoder devices for sensing the position of the actuator or a displaceable part of the chair.

The chair of FIGS. 10 to 12 is thus able to detect and respond to an overload condition in each of a number of stages of reconfiguration, despite the residual amount of current drawn by the actuator thereof differing between stages.

Whilst a plurality of embodiments of reconfigurable chair have been described above, each having a different feature, it will be appreciated that any combination of those features may be incorporated into the same chair.

While the preferred embodiments of the invention have been shown and described, it will be understood by those skilled in the art that changes of modifications may be made thereto without departing from the true spirit and scope of the invention.

I claim:

1. A chair comprising an actuator for adjusting the configuration of the chair in at least two stages and means arranged to detect an increase in current drawn by the actuator above a different respective threshold value in each of said stages, wherein the detecting means are arranged to respond, when the current drawn by the actuator exceeds the prevailing threshold, by arresting or reversing the direction of adjustment of the chair.

2. A chair as claimed in claim 1, comprising means arranged to sense the prevailing configuration of the chair, for setting the appropriate threshold value.

3. A chair as claimed in claim 2, wherein said sensing means comprise one or more switches for sensing the position of the actuator or a displaceable part of the chair.

4. A chair as claimed in claim 2, wherein said sensing means comprise one or more Hall Effect sensors for sensing the position of the actuator or a displaceable part of the chair.

5. A chair as claimed in claim 2, wherein said sensing means comprise one or more optical encoder devices for sensing the position of the actuator or a displaceable part of the chair.

6. A chair as claimed in claim 1, wherein said at least two stages comprise a first stage, wherein position of the squab and or back of the chair is adjusted, and a second stage, wherein the position of a footrest of the chair is adjusted.

7. A chair as claimed in any of claim 1, wherein the detecting means are arranged to respond, when the current drawn by the actuator exceeds the prevailing threshold, by generating an audible or visual alarm signal.

8. An electronic control arrangement for controlling the operation of an actuator to adjust the configuration of a chair in at least two stages, the control arrangement comprising means for detecting an increase in current drawn by the actuator above a different respective threshold value in each of said stages, wherein the detecting means are arranged to respond, when the current drawn by the actuator exceeds the prevailing threshold, by arresting or reversing the direction of adjustment of the chair.

9. An electronic control arrangement as claimed in claim 8, comprising means arranged to sense the prevailing configuration of the chair, for setting the appropriate threshold value.

10. An electronic control arrangement as claimed in claim 8, wherein said sensing means comprise one or more switches for sensing the position of the actuator or a displaceable part of the chair.

11. An electronic control arrangement as claimed in claim 8, wherein said sensing means comprise one or more Hall Effect sensors for sensing the position of the actuator or a displaceable part of the chair.

12. An electronic control arrangement as claimed in claim 8, wherein said sensing means comprise one or more optical encoder devices for sensing the position of the actuator or a displaceable part of the chair.

13. An electronic control arrangement as claimed in claim 8, wherein said at least two stages comprise a first stage, wherein position of the squab and/or back of the chair is adjusted, and a second stage, wherein the position of a footrest of the chair is adjusted.

14. An electronic control arrangement as claimed in any of claim 8, wherein the detecting means are arranged to respond, when the current drawn by the actuator exceeds the prevailing threshold, by generating an audible or visual alarm signal.

15. A chair according to claim 1 comprising at least one actuator for adjusting the configuration of the chair and means by which a user can control the operation of the or each actuator to vary the configuration of the chair, in opposite directions, via respective switches or sensors on either side of the chair.

16. A chair as claimed in claim 15, wherein the operation of the or each actuator is controlled via respective proximity sensors on either side of the chair.

17. A chair as claimed in claim 16, wherein each proximity sensor comprises a charge-transfer capacitance sensor, wherein a fixed charge is transferred from a sensing element (whose capacitance is affected by the proximity of a seated person) to a sampling capacitor of known capacitance, the resulting voltage across the sampling capacitor providing a measure of the extent to which the capacitance of the sensing element is affected.

18. A chair as claimed in claim 17, wherein the sensing element comprises one or more wires incorporated into piping which extends across or around an edge of the side of the chair.

19. An electronic control arrangement for controlling the operation of at least one actuator in a chair according to claim 15 for adjusting the configuration of the chair, the arrangement comprising means by which a user can control the operation of the or each actuator to vary the configuration of the chair, in opposite directions, via respective switches or sensors on either side of the chair.

20. An electronic control arrangement as claimed in claim 19, wherein the operation of the or each actuator is controlled via respective proximity sensors on either side of the chair.

21. An electronic control arrangement as claimed in claim 20, wherein each proximity sensor comprises a charge-transfer capacitance sensor, wherein a fixed charge is transferred from a sensing element (whose capacitance is affected by the proximity of a seated person) to a sampling capacitor of known capacitance, the resulting voltage across the sampling capacitor providing a measure of the extent to which the capacitance of the sensing element is affected.

22. An electronic control arrangement as claimed in claim 21, wherein the sensing element comprises one or more wires incorporated into piping which extends across or around an edge of the side of the chair.

23. An electronic control arrangement for controlling the operation of at least one actuator in a chair according to claim 15 for adjusting the configuration of the chair to tilt the chair forwards, the arrangement comprising means for sensing whether a person is seated in the chair and for operating the or each actuator to return the chair from a tilted position to an upright position, when a person is no longer seated in the chair.

24. An electronic control arrangement as claimed in claim 23, wherein the sensing means comprise a pressure transducer.

25. An electronic control arrangement as claimed in claim 23, wherein the sensing means comprise a proximity sensor.

26. An electronic control arrangement as claimed in claim 25, wherein the proximity sensor is in the form of charge-transfer capacitance sensor, wherein a fixed charge is transferred from a sensing element (whose capacitance is affected by the proximity of a seated person) to a sampling capacitor of known capacitance, the resulting voltage across the sampling capacitor providing a measure of the extent to which the capacitance of the sensing element is affected.

27. An electronic control arrangement as claimed in claim 26, wherein the sensing element comprises one or more wires incorporated into piping formed around a cushion on the squab of the chair.

28. A chair according to claim 1 comprising at least one actuator for adjusting the configuration of the chair to tilt the chair forwards, means for sensing whether a person is seated in the chair for operating the or each actuator to return the chair from a tilted position to an upright position, when a person is no longer seated in the chair.

29. A chair as claimed in claim 28, wherein the sensing means comprise a pressure transducer.

30. A chair as claimed in claim 28, wherein the sensing means comprise a proximity sensor.

31. A chair as claimed in claim 30, wherein the proximity sensor is in the form of charge-transfer capacitance sensor, wherein a fixed charge is transferred from a sensing element (whose capacitance is affected by the proximity of a seated person) to a sampling capacitor of known capacitance, the resulting voltage across the sampling capacitor providing a measure of the extent to which the capacitance of the sensing element is affected.

32. A chair as claimed in claim 31, wherein the sensing element comprises one or more wires incorporated into piping formed around a cushion on the squab of the chair.

33. A chair according to claim 1 comprising at least one actuator for adjusting the configuration of the chair and a handset comprising a plurality of buttons for controlling the operation of the or each actuator, wherein the handset must be enabled prior to use, by pressing a plurality of buttons thereof in a predetermined sequence or combination.

34. A chair as claimed in claim 33, wherein the handset is automatically disabled when it has not been used for a pre-determined period time.

35. A chair as claimed in claim 33, wherein the handset is disabled by a user by operating a single button thereof or a plurality of buttons in a predetermined sequence or combination.

36. A chair as claimed in claim 33, wherein the sequence or combination of buttons which must be pressed to enable and/or disable the device can be set by the user.

37. A chair comprising at least one actuator for adjusting the configuration of the chair according to claim 1 and means for sensing whether a person is seated in the chair and for preventing the or each actuator from being operated via a handset or other operating device of the chair unless a person is seated in the chair.

38. A chair as claimed in claim 37, wherein the sensing means comprise a pressure transducer.

39. A chair as claimed in claim 37, wherein the sensing means comprise a proximity sensor.

40. A chair as claimed in claim 39, wherein the proximity sensor is in the form of charge-transfer capacitance sensor, wherein a fixed charge is transferred from a sensing element (whose capacitance is affected by the proximity of a seated person) to a sampling capacitor of known capacitance, the resulting voltage across the sampling capacitor providing a measure of the extent to which the capacitance of the sensing element is affected.

41. A chair as claimed in claim 40, wherein the sensing element comprises one or more wires incorporated into piping formed around a cushion on the squab of the chair.

42. An electronic control arrangement for controlling the operation of at least one actuator to adjust the configuration of a chair according to claim 1, the control arrangement comprising means for sensing whether a person is seated in the chair and for preventing the or each actuator from being operated via a handset or other operating device unless a person is seated in the chair.

43. An electronic control arrangement as claimed in claim 42, wherein the sensing means comprise a pressure transducer.

44. An electronic control arrangement as claimed in claim 42, wherein the sensing means comprise a proximity sensor.

45. An electronic control arrangement as claimed in claim 44, wherein the proximity sensor is in the form of charge-transfer capacitance sensor, wherein a fixed charge is transferred from a sensing element (whose capacitance is affected by the proximity of a seated person) to a sampling capacitor of known capacitance, the resulting voltage across the sampling capacitor providing a measure of the extent to which the capacitance of the sensing element is affected.

46. An electronic control arrangement as claimed in claim 45, wherein the sensing element comprises one or more wires incorporated into piping formed around a cushion on the squab of the chair.

* * * * *